US006019257A

United States Patent [19]

Rasmussen

[11] Patent Number: 6,019,257

[45] Date of Patent: Feb. 1, 2000

[54] TAPPING FAUCET

[75] Inventor: Jorgen Rasmussen, Skytteengen 16, Allerod, Denmark, DK-3450

[73] Assignee: Jorgen Rasmussen, Lyne, Denmark

[21] Appl. No.: 09/077,732

[22] PCT Filed: Dec. 5, 1996

[86] PCT No.: PCT/DK96/00514

§ 371 Date: Nov. 19, 1998

§ 102(e) Date: Nov. 19, 1998

[87] PCT Pub. No.: WO97/21625

PCT Pub. Date: Jun. 19, 1997

[30] Foreign Application Priority Data

Dec. 8, 1995 [DK] Denmark ..... 1412/95

[51] Int. Cl.[7] ..... B65D 83/00

[52] U.S. Cl. ..... 222/400.7; 222/518

[58] Field of Search ..... 222/400.7, 402.14, 222/518

[56] References Cited

U.S. PATENT DOCUMENTS

| | | | |
|---|---|---|---|
| 3,220,617 | 11/1965 | Veistrup | 222/400.7 |
| 3,612,354 | 10/1971 | Sitton et al. | 222/518 |
| 4,011,894 | 3/1977 | Barnes | 138/46 |
| 4,655,374 | 4/1987 | Guerette | 222/518 |
| 4,687,123 | 8/1987 | Hyde | 222/518 |
| 5,573,145 | 11/1996 | Groh | 222/400.7 |
| 5,607,084 | 3/1997 | George | 222/400.7 |

FOREIGN PATENT DOCUMENTS

| | | |
|---|---|---|
| 2 166 180 | 4/1971 | Germany . |
| 23 55 713 | 11/1973 | Germany . |
| 1307908 | 4/1970 | United Kingdom . |
| 1 477 476 | 10/1974 | United Kingdom . |
| 2 124 184 | 5/1983 | United Kingdom . |

*Primary Examiner*—Joseph A. Kaufman
*Attorney, Agent, or Firm*—Pennie & Edmonds LLP

[57] ABSTRACT

A faucet which serves for tapping of a liquid such as beer from a container, in which the liquid is under gas pressure. The faucet comprises a casing with an outlet duct and a valve plug placed in this for closing the faucet. In the stream direction, before the valve plug, there is at least one resistance body which is freely, axially slidable in the outlet duct for at least a predetermined distance. This body has a smaller cross section across the stream direction than that of the outlet duct. The dispensing process can automatically be regulated in such a way that a predetermined amount of foam will be present.

10 Claims, 1 Drawing Sheet

TAPPING FAUCET

BACKGROUND ART

The invention relates to a faucet for tapping a liquid such as beer from a container, in which the liquid is stored under pressure of a gas, e.g. $CO_2$, and where the faucet comprises a casing with an outlet duct and a valve plug placed therein, for closing the faucet.

Liquids, as e.g. beer, standing under pressure of $CO_2$ in a container, are inclined to foam when they are tapped by opening the faucet. This is desirable to a certain but not too large degree. If the foam is too violent, the glasses which are to be filled with beer and a suitable amount of foam will be filled with too much foam and too little beer. This is not good enough for the customers. The balance between beer and foam can, however, in these cases be obtained by stripping off the foam and one or more re-fillings, or simply by letting the foam settle and then fill again. By stripping off the foam some of the beer will be lost and refillings cause extra work and take additional time. In the meantime the consumers have to wait and this fact is far from always being satisfactory.

These inconvenient disadvantages have, for obvious reasons, claimed much attention, and over the years there has been many attempts to solve the problem, but so far in a dissatisfactory way.

This is due to several circumstances. The beer is normally tapped in portions in smaller amounts of, for instance ¼ or ½ liter. In this process the condition of the stream is more or less changing all the time, since the beer from standstill is accelerating upon opening of the faucet, and immediately after decelerating to standstill when the faucet is closed.

Some people are using a long time for tapping the beer, while others are faster. Furthermore, the gas pressure, that is the pressure for driving the liquid out through the faucet, can be subject to substantial changes, e.g. by adjusting the reduction valve, or if the container is supplied with too little driving gas. Furthermore, the temperature of the beer can vary significantly and thereby cause the gas pressure to fluctuate.

The conditions for dispensing the beer are in such way subject to even very large and partly also rapidly continuous changes. It has therefore up till now not been possible to control the foam process with a satisfactory result.

SUMMARY OF THE INVENTION

The purpose of the invention is to provide a tapping faucet which is able to automatically regulate the dispensing process by changings of conditions, in which the liquid, e.g. the beer, is dispensed, so that there continuously is obtained the foam degree which is chosen in advance, that means the relation between foam and liquid.

In this faucet, at least one stream resistance body is provided before the valve plug when viewed in the stream direction. This body is freely axially slidable in the outlet duct at least along a predetermined distance, and has a small cross section across the stream direction compared to that of the outlet duct. This provides a narrowing of the duct so that both the stream velocity and degree of foam of the beer are reduced. The reduction in foam is due to the ability of the resistance body to slide freely to and fro in the outlet duct depending upon the condition of the stream.

From PCT international patent application PCT/DK95/00376 is known a tapping faucet with a spout, in which the outlet duct is placed, and where the valve plug is placed at the end of a spindle which extends through the outlet duct to an area outside the casing. The spindle furthermore is connected to a handle to slide the spindle and thereby the valve plug to and fro in the outlet duct between a closed position where the valve plug is adjoining a seat in the outlet duct and an open position where the valve plug has been raised from the seat.

By an advantageous embodiment the resistance body can in this case have a central opening through which the spindle is extending and thereby is controlling the resistance body when this is axially slided to and fro in the outlet duct.

By forming the resistance body as a ring-shaped disc there is furthermore obtained a simple and inexpensive construction which at the same time yields great resistance when the liquid is streaming past the narrow edge of the disc.

In this construction there is a slot for the flowing through of liquid between the wall of the outlet duct and the outer periphery of the disc. Alternatively, the disc can, when it has a diameter corresponding to the diameter of the outlet duct, be controlled by the outlet duct, while the flowing through slot is between the spindle and the periphery of the disc opening. By a different alternative embodiment there are flowing slots as well at the interior as the exterior periphery of the disc.

The flowing conditions can be subject to very rapid changes when the liquid, e.g. beer, is dispensed in portions. In order to equalize the resistance body's controlling of the flowing process and thereby of the foam degree, the resistance body can be placed in such a way in the discharge duct, that it can be sliding at a predetermined friction along the wall of the outlet duct or along the spindle such that the oscillations of the resistance body thereby are damped. The friction can for instance be made by means of an elastic ring of e.g. rubber, which has been placed between the respective peripheries of the disc and either the wall of the outlet duct or the spindle. Alternatively, the resistance body can in its entirety be made of an elastomer, e.g. rubber.

The outlet duct can be divided into two or more cylindrical sections, which stepwise merge into each other. There can in this way, for instance, be two sections, an upper, wide section and a lower, narrow section which merge into each other via a conical connection section.

If the dimensions of the resistance body are adjusted to the upper section, there can advantageously be placed a lower stop upon e.g. the spindle to prevent the resistance body from closing totally the flowing through by, in certain situations during the axial oscillation movements abutting the connection section. When the resistance body is in the area at the lower stop, the liquid will flow, when the flowing slot is at the exterior periphery of the resistance body, diagonally downwards and inwards towards the axis of the discharge duct, whereby the liquid will be influencing the resistance body with an upwards directed force component which is inclined to slide the disc into the opposite direction of the stop.

BRIEF DESCRIPTION OF THE DRAWINGS

The invention will be explained more fully below by the following description of embodiments, which just serve as examples, with reference to the drawing, in which.

DETAILED DESCRIPTION OF THE PREFERRED EMBODIMENTS

Figure 1:
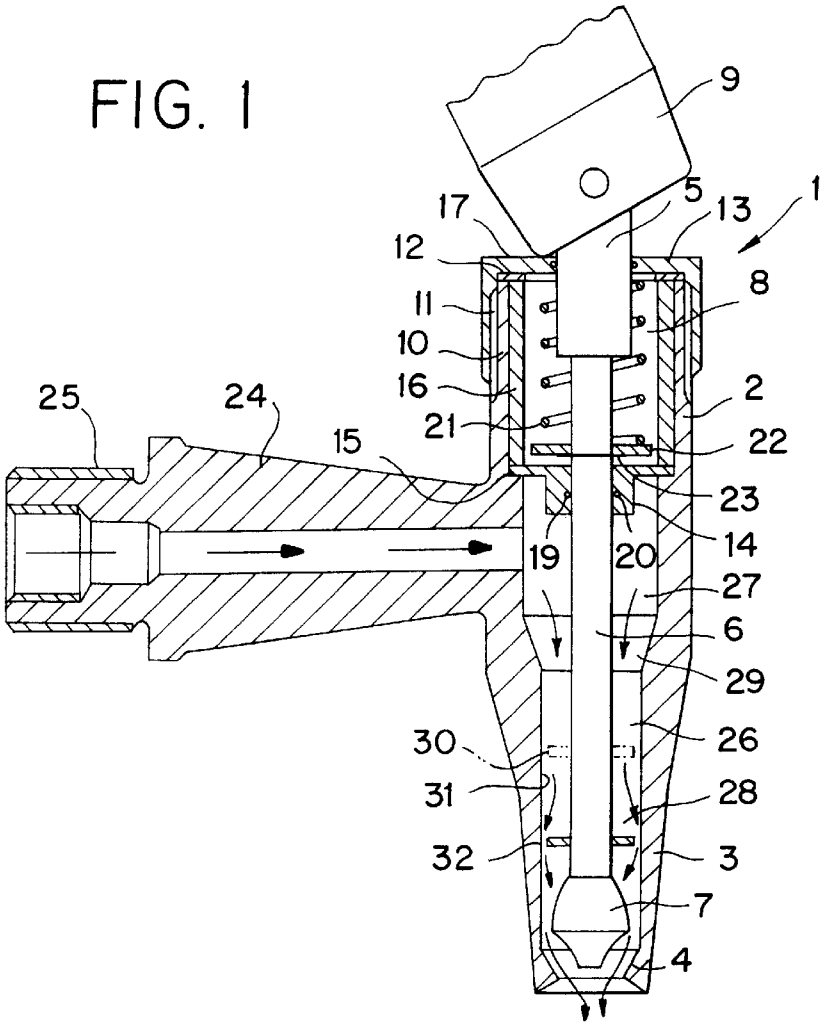
FIG. 1 shows a first embodiment of the faucet according to the invention.

In FIG. 1 can be seen a faucet according to the invention in a first embodiment. The faucet, which in its entirety is designated with the reference number 1, has a tubular valve casing 2 with a downwards turning spout 3, which at the bottom has a valve seat 4.

In the casing there is furthermore mounted a vertically slidable valve 5, which is composed of a spindle 6 and an lower valve plug 7. The spindle 6 extends at the top via a chamber 8 out through the casing 2 to the open, where the rod is connected to a handle 9 for sliding the valve up and down in order to open and close the faucet, respectively. In the figure the faucet has been opened by turning the handle 9, whereby the valve 5 has raised the valve plug 7 from the valve seat 4.

The chamber 8 is placed in the upper part of the casing, which part has been formed as a neck ring 10 with an exterior thread 11 for an interjacent packing 12 for tightening a screw cap 13 which is limiting the chamber 8 at the top. At the bottom the chamber 8 is furthermore limited by a sealing disc 14, which is abutting an inside shoulder 15 in the casing. The sealing disc 14 is pressed tightly down against this shoulder when the screw cap 13 is tightened, as the force of pressure generated by this operation is transmitted to the sealing disc via a distance ring 16.

The screw cap 13 has an opening 17 with an O-ring 18, and the sealing disc 14 has an opening with a second O-ring 20. The spindle 6 is due to the existence of the O-rings 18 and 20 led tight through the openings 17 and 19 in the sealing disc 14 and the screw cap 13, respectively, and the chamber 8 will therefore always be tightly closed against as well the outer milieu as the underlying part of the casing which, when in use, always will be filled with a liquid.

In the chamber 8 there is a pre-stressed pressure spring 21 which at the top leans against the screw cap 13 and at the bottom against a ring disc 22, which is fixed to the spindle 6 by means of a pressure spring 23. The elastic force of the pressure spring will consequently via the spindle 6 press the valve plug 7 down tightly against the valve seat 4 in the closing position of the faucet.

At the side between the spout 3 and the neck ring 10 the casing 2 has a tubular liquid inlet 24 with a screw branch 25 meant for, via a tube or a pipe (not shown) to connect the tapping faucet with a container (not shown) in which a beverage is stored under pressure of $CO_2$, which beverage in the following is supposed to be beer.

When a glass of beer is to be dispensed the valve is be raised by operating the handle 9 up to the position as shown in FIG. 4, where the faucet is open.

The $CO_2$ overpressure standing in the beer container, and which normally is reduced to a conveniently lower overpressure by means of a not shown reduction valve which has been switched in after the beer container, will now press the beer via the not shown tube- or pipe connection up to the tubular liquid inlet 24.

The beer will then stream via the liquid inlet 24, in direction of the arrows, into the spout 3 and further down through the outlet duct 26 and finally pass the open space between the valve seat 4 and the valve plug 7 and leave the faucet in a jet at the opening of the spout.

The outlet duct 26 will in this case be divided into an upper, wide section 27 and a lower, narrow section 28. The two sections 27,28 are emerging into each other via a conical intermediate section 29.

In the embodiment shown in FIG. 1 there is furthermore in the lower section 28 of the outlet duct 26 placed a ring-shaped disc 30. The disc is loosely placed upon the spindle 6, and between the exterior periphery of the disc and the wall 31 of the lower section 28 there is a slot 32 allowing the beer to flow round the disc. Since the disc in this way is free of the wall 31 and loosely placed on the spindle 6, it can be axially slided to and fro in the outlet duct 26 under the influence of the resultant of the dynamic and static forces from the beer stream and the gravitation. In FIG. 1 the disc 30 is shown with a full-drawn line in one axial position and with a dotted line in a different axial position.

In the beer container the beer is under pressure of gaseous $CO_2$. Thereby the beer will contain dissolved $CO_2$ to an extend which depends of the $CO_2$ pressure. If the pressure falls, the beer will not be able to contain so much $CO_2$. The additional amount is disengaged in gas form.

Due to the surface tension of the beer it will be inclined to foam when the gaseous $CO_2$ is coming out of the beer in the shape of growing bubbles. This is what normally takes place when the beer is dispensed, and the pressure will consequently fall from the pressure in the faucet to the pressure of the atmosphere of approximately 1 bar. If the pressure fall is too sudden the foam will be more violent than desired. Usually, a certain amount of foam is desired, and this can be defined as the relation between the foam and liquid volume, or the foam degree.

If the desired foam degree is to be obtained, the stream process has to be kept under control. The point is to avoid too sudden a drop of pressure at the outlet of the spout. However, since the parameters, which influence the pressure, can vary by alteration of the pressure above the beer in the container and by regulation of the reduction valve, and which by the way more or less all the time is changing in the dispensing process, where the beer with a rather short space of time is changing stream velocity from zero to maximum and back to zero again, there is no firm adaptation and adjustment of a conventional faucet, where the foam degree is at optimum under all circumstances.

In the faucet according to the invention shown in FIG. 1 a drop of pressure emerges above the disc 30, since the beer is streaming through the slot 32 between the disc and the wall 31 of the outlet duct. Between the disc and the outlet of the spout there is therefore a liquid column with a reduced pressure. The dissolved $CO_2$ in this will partly be transformed into a gaseous $CO_2$ in the shape of gas bubbles.

A liquid which in this way is filled with gas bubbles will no longer act as a pure liquid, but has instead become the character of an elastic medium. The column below the disc will consequently, opposite to a proper liquid, be able to be compressed and expand to a substantial extend in dependence of the forces, which are influencing the column.

The velocity of dispense or the velocity of stream at the outlet of the spout is depending of the pressure after the reduction valve and of the total stream resistance from this to the outlet of the spout.

The elastic liquid column below the disc 30 will try to expand into directions, where it is possible, and this possibility will exist at the outlet of the spout and at the axially free displaceable disc.

At the outlet of the spout the expansion will contribute to increase the velocity of stream, and at the opposite end of the column, the disc 30 will be moved from e.g. the position shown in FIG. 1 with a full-drawn line to the position shown with a dotted line. Thereby the column will be prolonged and the gas bubbles will have time to grow bigger, until they reach the outlet of the spout. The drive pressure above this will therefore be smaller whereby the velocity of dispense and thereby the foam degree will be reduced.

The pressure above the disc 30 will in this short time normally be unchanged, and since the pressure in the liquid column due to the expansion of this has become smaller, the pressure below the disc will correspondingly be smaller, e.g. downwards to the outlet of the spout. Thereby the opposite process to the one stipulated will take place, and the disc will in dependence of the alterations of the said parameters and with an adequate size of the slot 32, pendle to and fro in the outlet tube and thereby automatically provide an optimum foam degree under all circumstances.

If the liquid column below the disc 30 acted like a normal liquid, the disc would be led down to the valve plug 7 by the streaming liquid. As mentioned, the liquid column below the disc 30 is, however, not acting like a normal liquid. It is elastic and will try to expand, if it is possible. In order to obtain the desired effect, it is, however, important that the liquid in the column also can be compressed. When the liquid above the disc 30 in the shape of a ring-shaped jet hits the liquid below the disc after having passed the slot 32, that part of the liquid, which is situated just below the slot 32, will elastically catch the liquid jet and cause the jet to deflect its direction so that part of the liquid jet is supplied with a component, which is directed up towards the underside of the disc 30. This component will result in the disc being able to be kept in balance in the outlet duct without finally being drawn downwards to the valve plug by the liquid stream.

Figure 2:
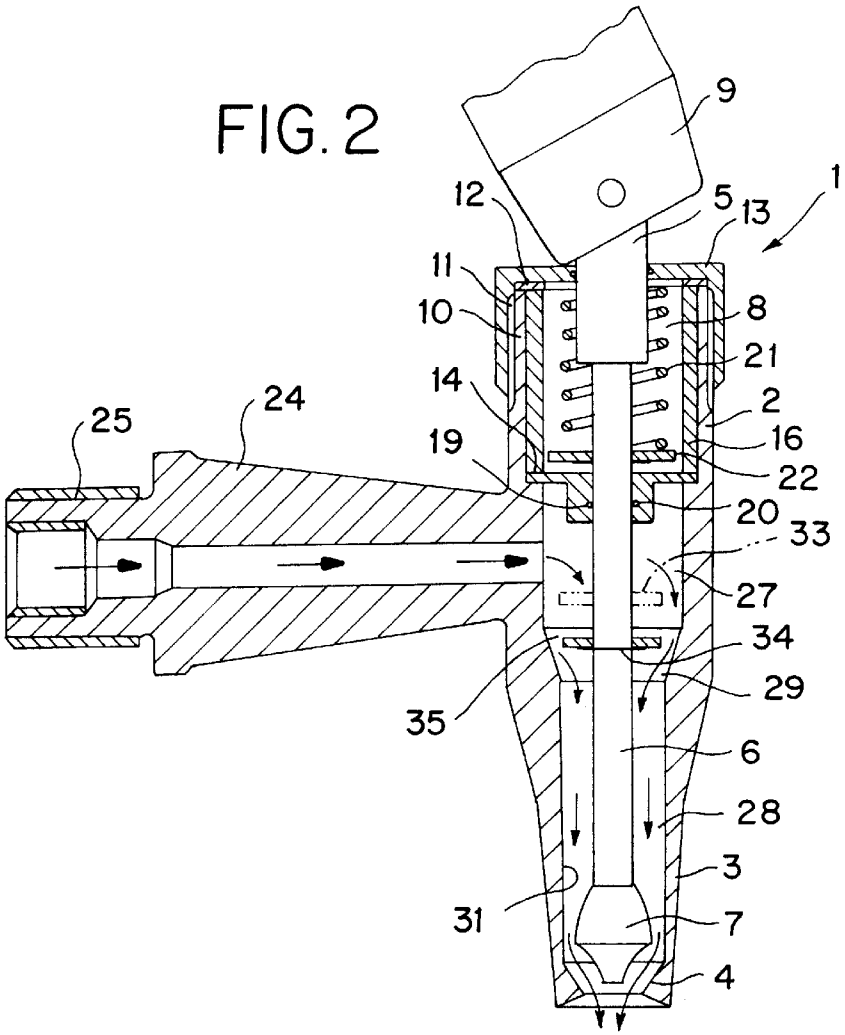
FIG. 2 shows a second embodiment of the faucet according to the invention.

FIG. 2 shows a second embodiment for a faucet according to the invention. This embodiment is almost in every respect equal to the one shown in FIG. 1, and similar parts are therefore designated with the same reference number.

In this case the disc 33 is, however, placed in such a way in the outlet duct 26, that it can pendle between a position shown with a full-drawn line in the intermediate section 29 and a position shown with a dotted line in the upper section 27. Furthermore, there is placed a stop ring 34 upon the spindle 6 to prevent the disc 30 from coming so far down that it, when touching the wall of the connection section 26 will shut off the liquid stream through the outlet duct.

The construction shown in FIG. 2 acts in the same way as the one mentioned in FIG. 1. The liquid column below the disc 33 is, however, longer and has a larger volume and can consequently better serve for compensation for the variations, which the drive parameters undergo or can undergo during the dispensing.

Another advantage is, that the ring-shaped liquid jet, which from above passes down through the slot 35 between the disc 33 and the wall of the outlet duct 26, already before meeting the elastical liquid column above the disc, is bended inwardly towards the axis of the outlet duct by the wall of the conical intermediate section 29, so that it better can be secured that part of the liquid jet is supplied with a upwards going component to keep the disc 13 in a pendling balance.

The invention is described above and on the drawing shown as a tapping faucet for dispensing a liquid, which liquid is driven out of the faucet under the influence of the overpressure from a drive gas.

The invention can, however, within the scope of the invention, be used for any type of valve, where a liquid under similar conditions has to dispensed.

What is claimed is:

1. A faucet for tapping a liquid from a container, in which the liquid is stored under pressure of a gas, the faucet comprising a casing having an outlet duct and a valve plug placed therein for closing the faucet, and at least one stream resistance body having a smaller cross section than the outlet duct and which is placed in the outlet duct upstream of the valve plug, the body being freely axially slidable in the outlet duct at least along a predetermined distance.

2. The faucet of claim 1, which farther comprises a spout in which the outlet duct is placed, a spindle which extends from the valve plug through the outlet duct to an area outside of the casing, with the spindle being connected to a handle that can be used to slide the spindle and valve plug to and so in the outlet duct between a closed position where the valve plug is adjoining a seat in the outlet duct and an open position where the valve plug has been raised from the seat, and the resistance body has a central opening through which the spindle extends.

3. The faucet of claim 1, wherein the resistance body comprises a ring-shaped disc.

4. The faucet of claim 1, which further comprises a lower stop for the resistance body.

5. The faucet of claim 1, which firer comprises an upper stop for the resistance body.

6. The faucet of claim 1, wherein the outlet duct has an upper generally wider section, a lower generally narrower section, and a generally conical connection section placed between the upper and lower sections, the resistance body is placed in the upper section of the outlet duct, and a stop is provided on a spindle or in the outlet duct preventing the resistance body from contacting the connection section of the outlet duct at least when the faucet is open.

7. The faucet of claim 1, wherein the outlet duct has an upper, generally wider section, a lower, generally narrower section, and a generally conical connection section placed between the upper and lower sections, and the resistance body is placed in the lower section of the outlet duct.

8. The faucet of claim 1, wherein the resistance body is slidably placed in the outlet duct with a predetermined friction in relation to the wall of the outlet duct.

9. The faucet of claim 2, wherein the resistance body has the central opening that has a diameter that is essentially equal to that of the spindle, and the spindle extends the resistance body opening.

10. The faucet of claims 1, wherein the resistance body has a diameter that is essentially equal to the diameter of the outlet duct.

* * * * *

UNITED STATES PATENT AND TRADEMARK OFFICE

CERTIFICATE OF CORRECTION

PATENT NO. : 6,019,257

DATED : February 1, 2000

INVENTOR(S) : Jorgen Rasmussen

It is certified that the errors appear in the above-identified patent and that said Letters Patent is hereby corrected as shown below:

Claim 2, line 1, change "farther" to -- further --.

Claim 5, line 1, change "firer" to -- further --.

On the title page, item [73] should read: MASKINFABRIKKEN "REA" APS

Signed and Sealed this

Twenty-second Day of August, 2000

*Attest:*

Q. TODD DICKINSON

*Attesting Officer*

*Director of Patents and Trademarks*